US006443764B2

(12) United States Patent
Makita

(10) Patent No.: US 6,443,764 B2
(45) Date of Patent: Sep. 3, 2002

(54) WATERTIGHT CONNECTOR, A CONNECTOR HOUSING AND A WATERPROOF MEMBER THEREFOR

(75) Inventor: Yasumitsu Makita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/852,105

(22) Filed: May 9, 2001

(30) Foreign Application Priority Data

May 11, 2000 (JP) ..... 2000-138397

(51) Int. Cl.[7] ..... H01R 13/40

(52) U.S. Cl. ..... 439/587; 439/271; 439/272; 439/273; 439/589

(58) Field of Search ..... 439/587, 589, 439/271, 272, 273

(56) References Cited

U.S. PATENT DOCUMENTS 5,336,101 A * 8/1994 Kasugai et al. ..... 439/272
5,993,233 A * 11/1999 Fukuda ..... 439/271

FOREIGN PATENT DOCUMENTS

JP 8-45601 2/1996

* cited by examiner

*Primary Examiner*—Tho D. Ta
(74) *Attorney, Agent, or Firm*—Anthony J. Casella; Gerald E. Hespos

(57) ABSTRACT

A watertight connector is provided to prevent a bulging portion of a waterproof member from being pushed radially inwardly by the leading end of a mating housing. The connector has a male housing (10) with an engaging space (34) in which a skirt (11) of a female housing (20) can be accommodated. A bottom portion (34A) of the engaging space (34) has its radially outward portion deepened backwardly to form a recess (35). A projection (39) formed on a seal ring (36) is fitted in and held by the recess (35). Thus, a force of a slanted surface (11B) formed at a leading end (11A) of the skirt (11) to push a bulging portion (38) away radially inwardly is restricted by the presence of the recess (35), to prevent the bulging portion 38 being pushed radially inwardly. This can securely prevent shaking of the housings (10, 20) in their connected state and fine sliding abrasion between the terminal fittings (12, 22).

3 Claims, 6 Drawing Sheets

WATERTIGHT CONNECTOR, A CONNECTOR HOUSING AND A WATERPROOF MEMBER THEREFOR

BACKGROUND OF THE INVENTION

1. Field of the Invention

The invention relates to a watertight connector, a connector housing and a waterproof member for a connector housing.

2. Description of the Related Art

A watertight connector is identified by the numeral 101 in FIG. 6 and also is disclosed in Japanese Unexamined Patent Publication No. 8-45601. The watertight connector 101 has male and female housings 110, 120 that are connectable with each other. The female housing 120 is formed with a receptacle 122 that defines an engaging space for accommodating the male housing 110. The female housing 120 also includes a ring-shaped elastic waterproof member 123 mounted near a bottom end of the engaging space. The male housing 110 is formed with a skirt 112 that can be inserted into the engaging space of the female housing 120. Thus, the waterproof member 123 is held tightly between the housings 110 and 120 and provides a watertight fit when the housings 110, 120 are connected.

The waterproof member 123 of the watertight connector 101 has a bulging portion 124 at the bottom of the engaging space. The bulging portion 124 allows the housings 110, 120 to be held in contact with each other in their assembling directions. The housings 110, 120 are held by the bulging portion 124, and thus are prevented from shaking. As a result, fine sliding abrasion caused by fine sliding movements between a female terminal fitting 121 and a male terminal fitting 111 is avoided.

A slanted surface 112B may be formed at the inner side of a leading end 112A of the skirt 112 to avoid contact with the waterproof member 123 during insertion. However, the leading end 112A may enter between the bulging portion 124 and an inner wall 122A of the receptacle 122 during the connection of the housings 110, 120. As a result, the slanted surface 112B may push the bulging portion 124 radially inwardly (see FIG. 7). Radially inward deformation of the bulging portion 124 may prevent the bulging portion 124 from sufficiently displaying its elasticity, and may reduce its effect against fine sliding abrasion. Thus, there has been a demand for an improvement.

In view of the above, an object of the invention is to prevent the leading end of the housing from pushing the bulging portion of a waterproof member radially inwardly.

SUMMARY OF THE INVENTION

The invention is directed to a watertight connector with first and second housings that are at least partly connectable with each other. A skirt is provided on the first housing and a receptacle is provided in the second housing. The receptacle includes an engaging space that is dimensioned to receive at least part of the skirt. A locking means may be provided on at least one of the housings to lock the housings in their mated condition.

An elastic waterproof member is mounted in the engaging space and can be squeezed between the two housings. The elastic waterproof member has at least one bulging portion, and at least one bulging portion holding means is formed in the engaging space to prevent the bulging portion from deforming elastically inwardly. The bulging portion and the bulging portion holding means may be at a bottom of the engaging space.

The bulging portion holding means has a radially outward portion that bulges out more than its radially inward portion. Thus, the bulging portion holding means prevents the bulging portion from being pushed radially inward by the skirt of the first housing. Specifically, at least one step may be formed in the second housing by deepening a radially outward portion at the bottom of the engaging space. Alternatively, the bottom of the engaging space may be formed with a slanted surface that is inclined with respect to a radially outward direction. With either design, the bottom is deeper at its radially outer side than at its radially inner side. This can prevent shaking of the housings in their connected state and therefore can prevent fine sliding abrasion between male and female terminal fittings.

The bulging portion holding means may be provided over the entire periphery of the bottom portion of the engaging space. Thus, the prevention of the radially inward elastic deformation of the bulging portion and associated shaking of the housings can be prevented more securely. Alternatively, a plurality of bulging portion holding means may be spaced circumferentially around the engaging space.

The bulging portion holding means and the bulging portion may comprise correspondingly shaped slanted surfaces.

The invention also is directed to a connector housing for a watertight connector. The housing includes a receptacle for at least partly accommodating a mating portion of a mating connector housing. The housing also includes an engaging space inside the receptacle. The engaging space is adapted to receive at least part of the mating portion. An elastic waterproof member is disposed in the engaging space and can be squeezed between the two housings. The elastic waterproof member has at least one bulging portion. At least one bulging portion holding means is in the engaging space to prevent the bulging portion from being elastically deformed radially inwardly.

According to a preferred embodiment, the bulging portion and the bulging portion holding means are at the portion of the engaging space.

Preferably, the bulging portion holding means is provided over substantially the entire periphery of the engaging space.

The invention also is directed to a waterproof member for a watertight connector that can be mounted in an engaging space of a connector housing and squeezed between the connector housing and a mating connector housing of the watertight connector. The waterproof member comprises at least one bulging portion to be located at the engaging space. The bulging portion is prevented from being elastically deformed radially inwardly by interaction with at least one bulging portion holding means in the engaging space.

These and other objects, features and advantages of the present invention will become apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
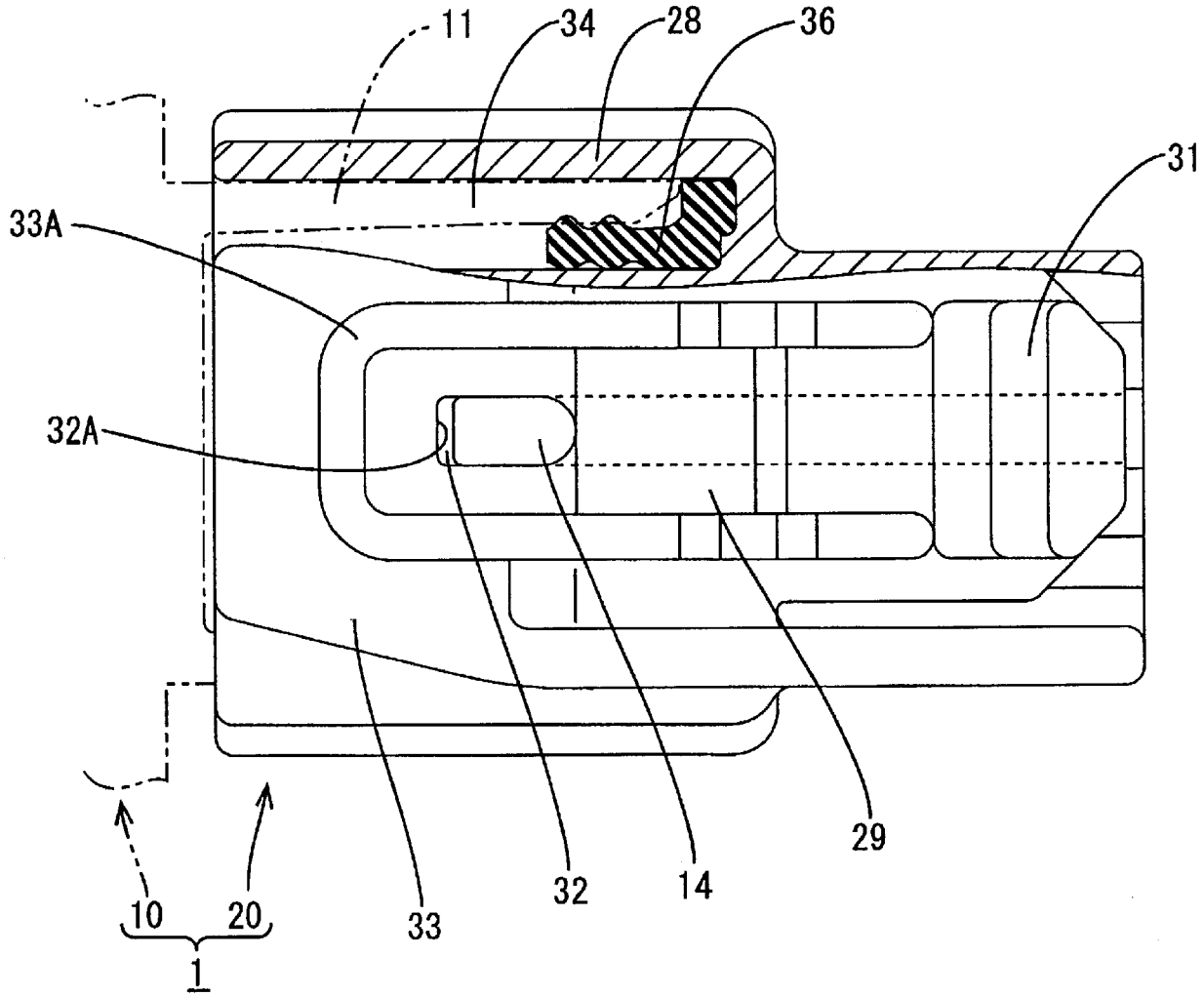
FIG. 1 is a plan view of female and male housings of a watertight connector according to a first embodiment in their connected state.
Figure 2:
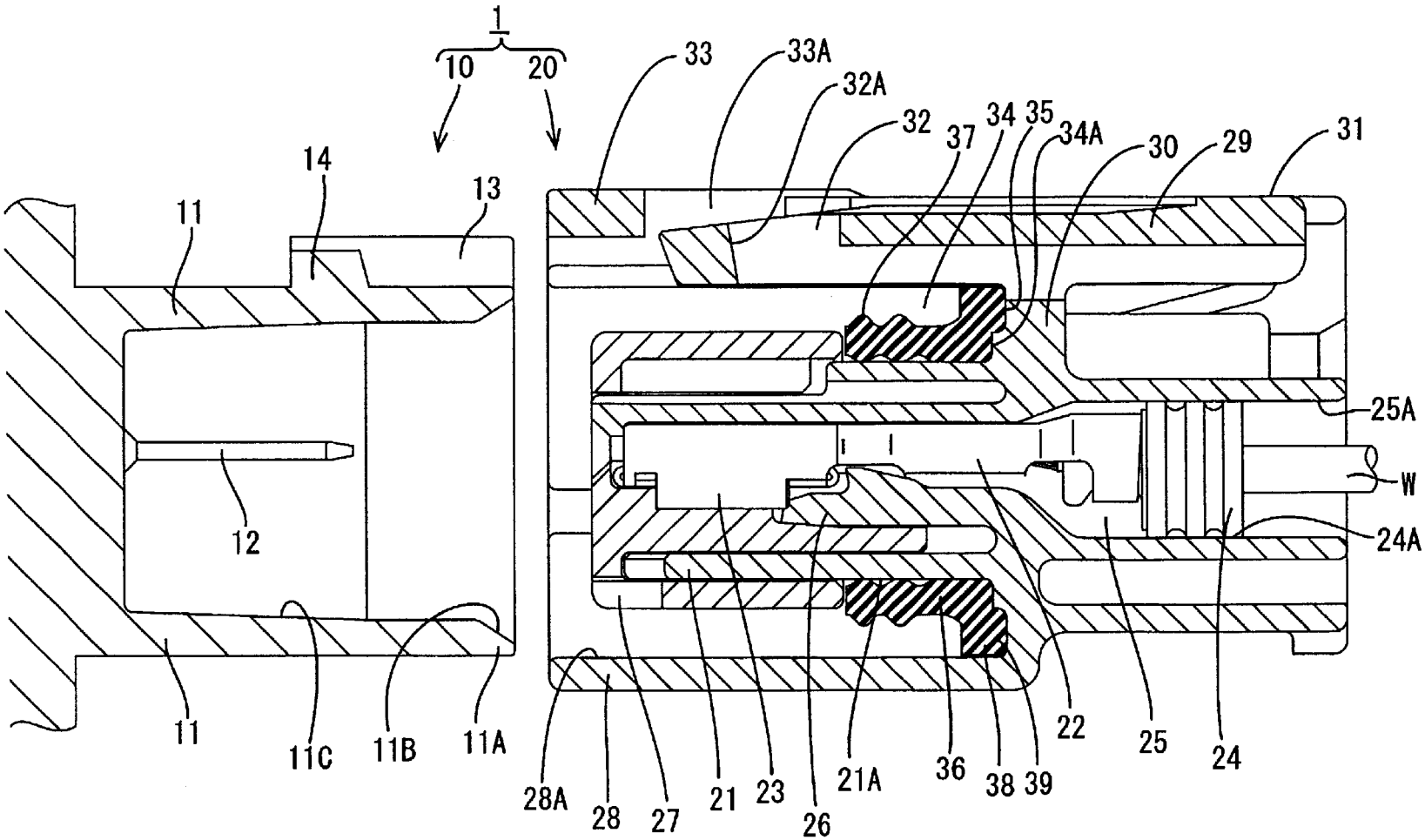
FIG. 2 is a section of the female and male housings of the watertight connector according to the first embodiment before they are connected.
Figure 3:
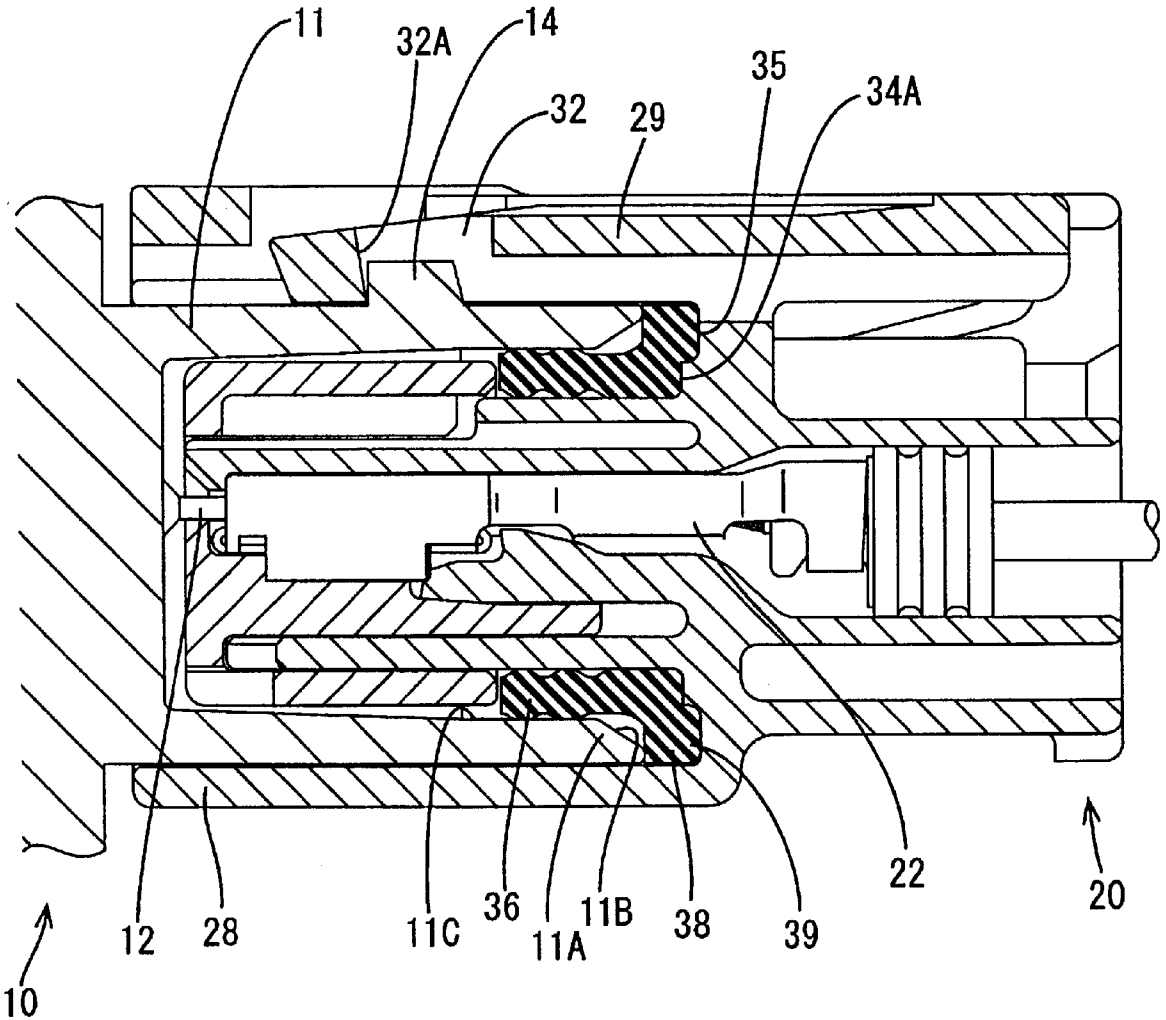
FIG. 3 is a section of the female and male housings of the watertight connector according to the first embodiment in their connected state.

A watertight connector according to a first embodiment of the invention is identified by the numeral 1 in FIGS. 1 to 3. The watertight connector 1 has a male connector housing 10 and a female connector housing 20 that are at least partly connectable with each other. In the following description, the side of each respective housing 10, 20 that is to be connected with the mating housing 20, 10 is referred to as the front.

The male housing 10 is formed unitarily of a synthetic resin, and has a substantially rectangular tubular skirt 11 with an open front 11A, as shown in FIG. 2. Male terminal fittings 12 project forwardly from a bottom wall that extends transversely across the rear end of the skirt 11. The male terminal fittings 12 are spaced at specified intervals in a widthwise direction across the bottom wall. Left and right parallel guide walls 13 extend in forward and backward directions on the upper surface of the skirt 11 and are disposed on opposite respective sides of the widthwise center. A lock 14 projects from the upper surface of the skirt 11 and extends transversely between the guide walls 13. The lock 14 is engageable with a lock arm 29 of the female housing 20, as explained below. A slanted surface 11 B is formed at the inner side of the front end 11A of the skirt 11 and prevents interference between the skirt 11 and a seal ring 36 during insertion of the skirt 11 into an engaging space 34 of the female housing 20.

The female housing 20 is formed unitarily of a synthetic resin into a substantially rectangular parallelepipedic shape, and has a terminal accommodating portion 21 that can be fit at least partly into the skirt 11 of the male housing 10. Cavities 25 are formed in the female housing 20 and correspond in location and number to the male terminal fittings 12 of the male housing 10. Female terminal fittings 22 can be inserted into the corresponding cavities 25 from behind, and are locked elastically in the cavity 25 by a locking portion 26 that projects into in the cavity 25. A front retainer 27 intersects the cavities 25 and redundantly locks the female terminal fittings 22.

A substantially rectangular connecting portion 23 is defined at the front of each female terminal fitting 22 and is dimensioned to receive the male terminal fitting 12. The rear of the female terminal fitting 22 is connected to one end of a wire W.

A generally tubular waterproof rubber plug 24 has opposite front and rear ends, an outer circumferential surface 24A and an insertion hole that defines an inner circumferential surface (not shown). The wire W is inserted through the insertion hole of the rubber plug 24 so that the inner circumferential surface is in sealing engagement with the outer surface of the wire W. Additionally, the rubber plug 24 is positioned on the wire W so that the front end of the rubber plug 24 abuts and covers the rear surface of each female terminal fitting 22. The outer circumferential surface 24A of the rubber plug 24 is dimensioned for sealing engagement with the inner circumferential surface 25A of each cavity 25. Thus the rubber plugs 24 keep the cavities 25 watertight when the female terminal fitting 22 is fit into the cavity 25.

The female housing 20 has a substantially tubular receptacle wall 28 that surrounds the terminal accommodating portion 21 and projects forward of the female housing 20. An engaging space 34 is defined between an inner surface 28A of the receptacle wall 28 and an outer surface 21A of the terminal accommodating portion 21. The engaging space 34 is dimensioned to receive the skirt 11 of the male housing 10.

The lock arm 29 is on the upper surface of the receptacle wall 28 and is elastically deformable toward and away from the terminal accommodating portion 21. The lock arm 29 is narrow from side to side, and can be inclined like a seesaw about a supporting point 30 aligned substantially with the bottom of the receptacle 28. The upper surface of the receptacle 28 projects upward around the lock arm 29 to form a projecting portion 33, and the two guide walls 13 and the lock 14 of the male housing 10 can be accommodated inside the projecting portion 33. The projecting portion 33 has an escape groove 33A that is open at the rear of the projecting portion 33 to permit an upward pivotal movement of the front end of the lock arm 29. A pushing portion 31 is provided on the upper surface of the rear end of the lock arm 29 for unlocking the lock arm 29. A groove 32 is slightly behind the front end of the lock arm 29, and can engage with the lock 14 of the male housing 10.

The seal ring 36 is made of an elastic material (e.g. rubber) and is mounted substantially at the bottom end of the engaging space 34. The seal ring 36 has an inner circumferential surface dimensioned for sealing contact with the outer circumferential surface 21A of the terminal accommodating portion 21 while the rear end of the seal ring 36 is held in sealing contact with the bottom 34A of the engaging space 34. Further, a plurality of lips 37 are formed on the inner and outer circumferential surfaces of the seal ring 36.

A bulging portion 38 projects radially outwardly from the outer circumferential surface of the rear end of the seal ring 36. The bulging portion 38 extends to a position where its projecting end can contact the inner surface 28A of the receptacle 28. Thus the bulging portion 38 is squeezed between the bottom 34A of the engaging space 34 and the front 11A of the skirt 11 when the housings 10, 20 are connected with each other. Radially outer portions at the rear end of the bulging portion 38 define an annular projection 39 that contacts the bottom 34A of the engaging space 34. On the other hand, a radially outward portion of the bottom 34A of the engaging space 34 is deepened to form an annular recess 35. When the seal ring 36 is mounted, the annular projection 39 of the seal ring 36 is fit into the annular recess 35.

To connect the male and female housings 10, 20, the skirt 11 of the male housing 10 is inserted at least partly into the engaging space 34 of the female housing 20. The skirt 11 can be inserted smoothly without getting caught by the lips 37 on the seal ring 36 due to the slanted surface 11B at the leading end 11A of the skirt 11. On the other hand, the lock 14 of the male housing 10 contacts the lock arm 29 of the female housing 20, and causes the lock arm 29 to pivot elastically and move onto the lock 14.

The male and female terminal fittings 12, 22 connect with one another as the housings 10, 20 become properly connected. Simultaneously, the lock arm 29 is restored elastically substantially to its original position to engage the lock 14 in the groove 32 and to lock the housings 10, 20 together, as shown in FIG. 3. The seal ring 36 is squeezed between an inner surface 11C of the skirt 11 and the outer surface 21A of the terminal accommodating portion 21 while deforming the lips 37 on the seal ring 36. Thus, a watertight connection is achieved. The leading end 11A of the skirt 11 is pushed elastically against the bulging portion 38 of the seal ring 36, and an elastic restoring force of the bulging portion 38 pushes the male housing 10 back. As a result, the lock 14 is pressed elastically against a front wall surface 32A of the groove 32, and the housings 10, 20 are prevented from shaking in their connected state.

The outward portion of the bottom 34A of the engaging space 34 is deepened rearwardly or in an insertion direction of the male connector housing 10 into the female connector housing 20 to form the annular recess 35. As shown in FIG. 2, the annular projection 39 on the seal ring 36 is fit in and held by the annular recess 35. Thus, forces generated by the slanted surface 11B of the skirt 11 that might push the bulging portion 38 radially inwardly are restricted by the engagement of the annular projection 39 in the annular recess 35, thereby preventing the bulging portion 38 from being pushed radially inwardly. This prevents the housings 10, 20 from shaking in their connected state and prevents fine sliding abrasion between the terminal fittings 12, 22.

The annular recess 35 preferably is formed over the entire periphery of the bottom 34A of the engaging space 34. This prevents the bulging portion 38 from being pushed radially inwardly and prevents the housings 10, 20 from shaking in their connected state. However, two or more annular recesses 35 may be provided separately in a spaced manner, preferably in a substantially equally circumferential spaced manner.

Figure 4:
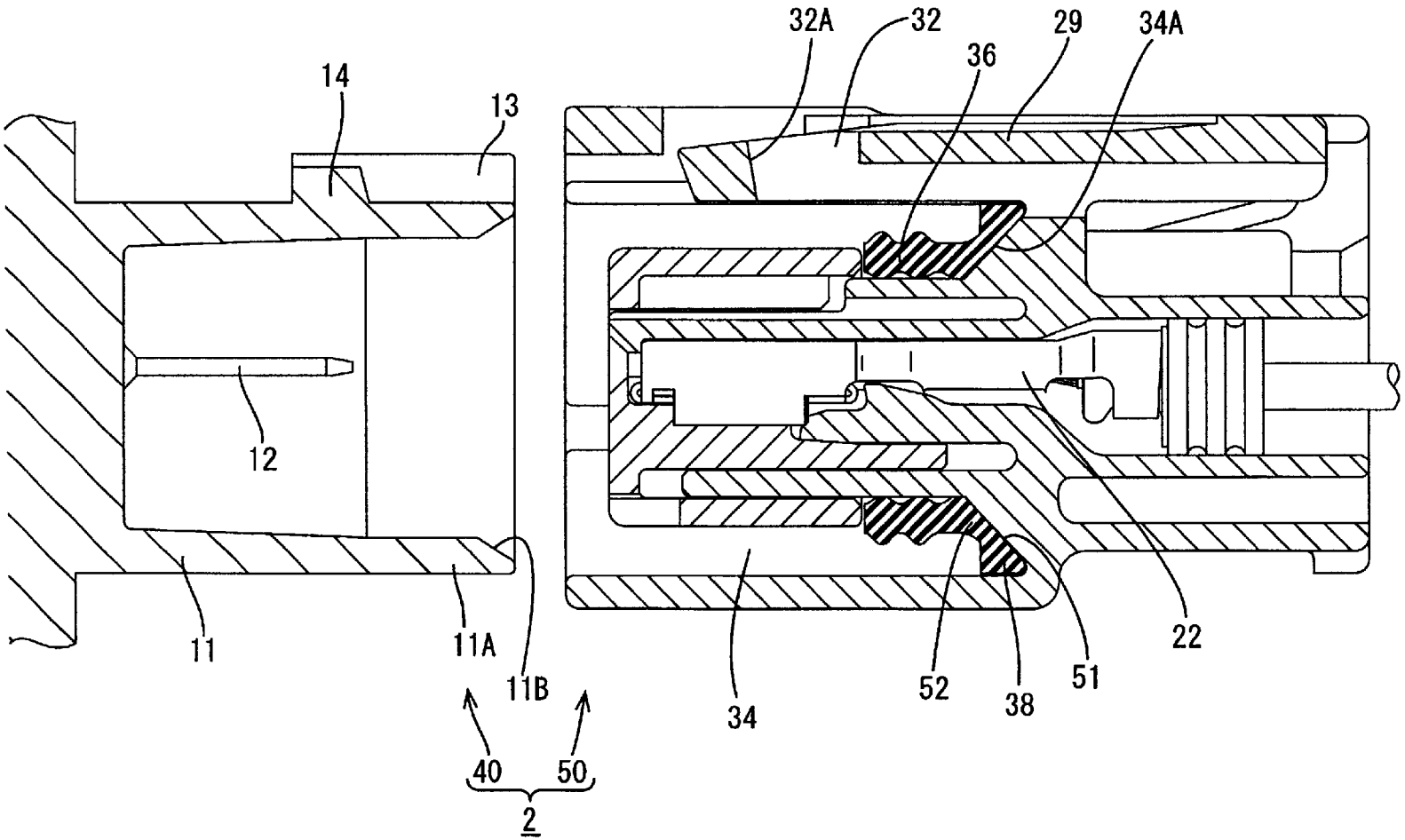
FIG. 4 is a section of a female and a male housings of a watertight connector according to a second embodiment before they are connected.

A watertight connector in accordance with a second embodiment of the invention is identified by the numeral 2 in FIG. 4. The watertight connector 2 is comprised of a male housing 40 and a female housing 50 that are at least partly connectable with each other. Elements of the second embodiment that are the same as or similar to corresponding elements in the first embodiment are not described, but are identified by the same reference numerals.

A main difference between the first and second embodiments lies in the construction of the bulging portion holding means. Specifically, the bottom 34A of the engaging space 34 defined in the receptacle wall 28 of the female housing 50 is formed into a slanted portion 51 that is inclined outwardly so that the bottom 34A is deeper at more outward positions. On the other hand, the surface of the rear end of the bulging portion 38 that contacts the slanted portion 51 of the engaging space 34 defines a slanted surface 52. Thus, the slanted surface 52 of the seal ring 36 substantially conforms to the slanted portion 51 when the seal ring 36 is mounted.

Figure 5:
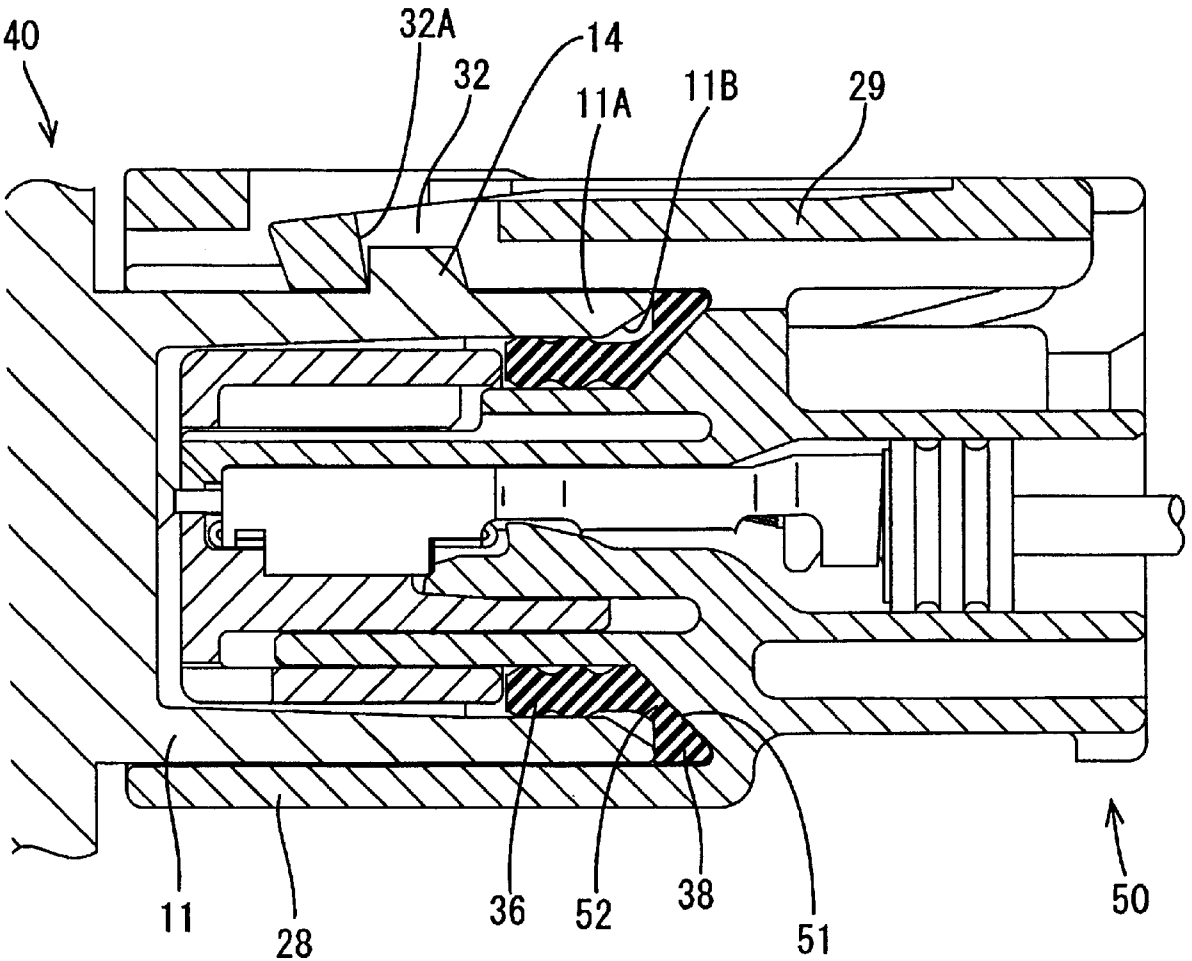
FIG. 5 is a section of the female and male housings of the watertight connector according to the second embodiment in their connected state.
Figure 6:
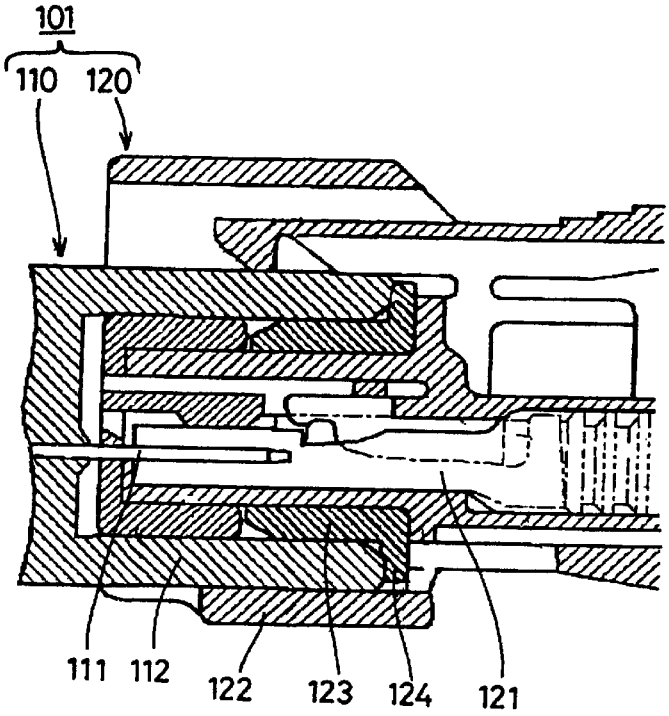
FIG. 6 PRIOR ART
FIG. 6 is a section of a prior art watertight connector.
Figure 7:
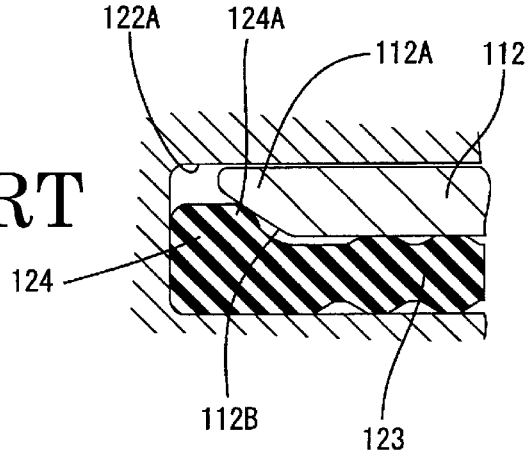
FIG. 7 PRIOR ART
FIG. 7 is an enlarged view of a portion of a seal ring of the prior art connector.

When the housings 40, 50 are connected properly, as shown in FIG. 5, the leading end 11A of the skirt 11 is pressed elastically against the bulging portion 38 of the seal ring 36, and the male housing 40 is pushed back by an elastic restoring force of the bulging portion 38 to elastically push the lock portion 14 against the front wall surface 32A of the lock arm 29. In this way, the housings 40, 50 are prevented from shaking in their connected state.

In this embodiment, the bottom 34A of the engaging space 34 is slanted radially outwardly and the seal ring 36 is formed with the slanted surface 52 on the seal ring 36 to be pressed against the slanted portion 51. Thus, a force of the slanted surface 11B of the skirt 11 to push the bulging portion 38 radially inwardly is restricted by the presence of the slanted portion 51, thereby the bulging portion 38 from being pushed radially inwardly. This can prevent shaking of the housings 40, 50 in their connected state and fine sliding abrasion between the terminal fittings 12, 22.

The present invention is not limited to the above described and illustrated embodiments. For example, the following embodiments are also embraced by the technical scope of the present invention as defined in the claims. Beside the following embodiments, various changes can be made without departing the spirit of the present invention as defined in the claims.

Although the skirt 11 is provided in the male housing 10, 40 and the engaging space 34 is defined in the female housing 20, 50 in the foregoing embodiments, the constructions of the skirt and the engaging space are not limited to those of the foregoing embodiments, and may be provided in the opposite housings according to the present invention.

Although the stepped portion or recess 35 and the slanted portion 51 are formed over the entire periphery of the bottom 34A of the engaging space 34 in the foregoing embodiments, the constructions of the recess and the slanted portion are not limited to those of the foregoing embodiments, and may be formed in part of the bottom of the engaging space as circumferentially spaced portions.

What is claimed is:

1. A connector housing for a watertight connector, said connector housing having opposed front and rear ends, and a connecting direction extending between the ends, a terminal accommodating portion formed in the connector housing and having outer surfaces aligned parallel to the connecting direction, a substantially tubular receptacle wall aligned substantially parallel to the connecting direction and extending rearwardly from said front end such that an engaging space is defined inwardly of the receptacle wall and outwardly from said terminal accommodating portion, said engaging space being defined in part by an inner bottom wall aligned normal to the connecting direction and extending outwardly from the terminal accommodating portion, and an outer bottom wall aligned substantially normal to the connecting direction and extending inwardly from said tubular receptacle wall and a step wall extending between said inner and outer bottom walls and aligned substantially parallel to the connecting direction, such that a rearwardly extending recess is defined adjacent said tubular receptacle wall and extends continuously around all locations in said engaging space adjacent to an interface between said tubular receptacle wall and said outer bottom wall, said recess being of substantially rectangular cross section; and a tubular elastic waterproof member mounted in said engaging space, said tubular elastic waterproof member having opposite front and rear ends, portions of said tubular elastic waterproof member adjacent said front end thereof being spaced inwardly from said tubular receptacle wall of said connector housing, portions of said tubular elastic waterproof member adjacent said rear end thereof engaging said tubular receptacle wall and being fit in said recess for preventing inward deformation of said rear end of said tubular elastic waterproof member away from said tubular receptacle wall by a leading end of a mating connector.

2. The connector housing of claim 1, wherein the tubular receptacle wall defines a substantially rectangular tube, and wherein the tubular elastic waterproof member defines a substantially rectangular tube.

3. The connector housing of claim 1, wherein inner surface regions of said tubular elastic waterproof member are in sealing engagement with said terminal accommodating portion.

* * * * *